US010173870B1

(12) United States Patent
Hall et al.

(10) Patent No.: US 10,173,870 B1
(45) Date of Patent: Jan. 8, 2019

(54) SWIVEL WINCH ROTATED VIA AN ACTUATOR IN RESPONSE TO PRESSURE SENSOR DATA

(71) Applicants: David R. Hall, Provo, UT (US); Daniel Madsen, Vineyard, UT (US); Alaina Hirschi, Provo, UT (US)

(72) Inventors: David R. Hall, Provo, UT (US); Daniel Madsen, Vineyard, UT (US); Alaina Hirschi, Provo, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 15/838,711

(22) Filed: Dec. 12, 2017

(51) Int. Cl.

| | |
|---|---|
| ***B66D 1/39*** | (2006.01) |
| ***B66D 1/50*** | (2006.01) |
| ***B66D 1/36*** | (2006.01) |
| ***B66D 3/22*** | (2006.01) |
| ***B66D 1/18*** | (2006.01) |
| ***B66D 1/00*** | (2006.01) |

(52) U.S. Cl.
CPC ..... *B66D 1/39* (2013.01); *B66D 1/005* (2013.01); *B66D 1/18* (2013.01); *B66D 1/365* (2013.01); *B66D 1/50* (2013.01); *B66D 3/22* (2013.01)

(58) Field of Classification Search
CPC . B66D 1/38; B66D 1/39; B66D 1/005; B66D 1/18; B66D 1/365; B66D 1/50
See application file for complete search history.

(56) References Cited

U.S. PATENT DOCUMENTS

| | | | | | |
|---|---|---|---|---|---|
| 2,660,382 | A * | 11/1953 | Wilson | B66D 1/36 | 242/157.1 |
| 2,988,292 | A * | 6/1961 | Bliss | B65H 54/2872 | 242/447.2 |
| 3,039,707 | A * | 6/1962 | Beck | B21F 3/04 | 140/71.5 |
| 3,524,606 | A * | 8/1970 | Coski | B65H 75/4402 | 242/484 |
| 3,536,298 | A * | 10/1970 | Deslierres | B63B 21/663 | 114/244 |
| 3,589,643 | A * | 6/1971 | Takizawa | B21C 47/02 | 242/447.3 |
| 3,931,938 | A * | 1/1976 | Hasegawa | B65H 59/385 | 242/413.3 |
| 4,692,063 | A * | 9/1987 | Conti | H02G 1/06 | 242/420 |
| 4,695,010 | A * | 9/1987 | Smith | B66D 1/38 | 242/157.1 |
| 5,090,666 | A * | 2/1992 | May | B66D 1/7415 | 254/329 |
| 5,551,545 | A * | 9/1996 | Gelfman | H02G 11/02 | 191/12.2 A |
| 5,636,648 | A * | 6/1997 | O'Brien | B08B 9/04 | 134/107 |
| 6,276,449 | B1 * | 8/2001 | Newman | B66D 1/18 | 166/53 |

(Continued)

*Primary Examiner* — Michael E Gallion

(57) ABSTRACT

A system and a method for a swivel winch are described for rotating a winch about an axis such that friction is reduced when letting out or pulling in a line. The swivel winch includes a fairlead with an orifice and sensors which sense the pressure from the cable and send the retrieved data to a controller which generates commands for an actuator, causing the swivel mount coupled to the winch to swivel in a direction that will relieve pressure.

20 Claims, 14 Drawing Sheets

(56) References Cited

U.S. PATENT DOCUMENTS 6,523,806 B2 * 2/2003 Bartal ..... B66D 1/00 254/272
6,811,112 B1 * 11/2004 Currie ..... B65H 54/2872 242/157.1
6,988,854 B2 * 1/2006 Porter ..... G02B 6/506 242/387
7,080,826 B2 * 7/2006 Pockl ..... B66D 1/365 254/332
7,226,038 B1 * 6/2007 Wickstrom ..... B66D 1/54 254/276
7,331,436 B1 * 2/2008 Pack ..... B65H 75/425 191/12.2 A
7,753,345 B2 * 7/2010 Arzberger ..... B66D 1/365 254/329
8,141,260 B2 * 3/2012 Pellen ..... G01B 11/26 33/366.24
9,399,566 B2 * 7/2016 Hall ..... B66D 1/38
9,637,360 B2 * 5/2017 Hall ..... B66D 5/32
9,719,632 B2 * 8/2017 Weidner ..... F16M 13/022
9,783,399 B2 * 10/2017 Hausladen ..... B66D 1/30
9,988,250 B2 * 6/2018 Hall ..... B66D 1/28
2007/0022935 A1 * 2/2007 Griffith ..... B63C 11/02 114/312
2008/0164365 A1 * 7/2008 Ueki ..... A01K 73/06 242/413.5
2010/0032509 A1 * 2/2010 Cazzaro ..... B66D 1/38 242/397.3
2010/0314594 A1 * 12/2010 Seow ..... B66D 1/36 254/333
2011/0162573 A1 * 7/2011 Race ..... H01Q 1/04 114/328
2013/0193256 A1 * 8/2013 Hawkes ..... B65H 75/4484 242/557
2014/0091268 A1 * 4/2014 Heravi ..... B66D 1/505 254/274
2014/0166953 A1 * 6/2014 Wright ..... B66D 1/56 254/270
2018/0105404 A1 * 4/2018 Hall ..... B66D 1/485

* cited by examiner

SWIVEL WINCH ROTATED VIA AN ACTUATOR IN RESPONSE TO PRESSURE SENSOR DATA

TECHNICAL FIELD

The present disclosure relates generally to the field of winches. More specifically, the present disclosure relates to an apparatus for a winch that swivels based on pressure data.

BACKGROUND

Winches are hauling or lifting devices, which pull in or let out a line. Winches function by winding or unwinding the line that is coiled around a rotating drum. A winch fairlead is commonly used to direct the line as it winds or unwinds along the drum. Typically, the line must be at a shallow angle to the fairlead in order to minimize friction between the line and the internal edges of the fairlead that surround the line. Thus, a problem arises if the line is connected to a load that is at a wide angle to the fairlead because friction between the line and the fairlead reduces the pulling capacity of the winch and shortens the life of the line (can cause the line to fray, for example).

SUMMARY

This invention has been developed in response to the present state of the art and, in particular, in response to the problems and needs in the art that have not yet been fully solved by currently available systems and methods. Features and advantages of different embodiments of the invention will become more fully apparent from the following description and appended claims, or may be learned by practice of the invention as set forth hereinafter.

Consistent with the foregoing, a system and method for a swivel winch are disclosed.

A winch is described that includes a rotatable drum comprising a winch cable windably connected to the winch drum, and a removable vehicle winch frame with two end brackets. The winch comprises a winch motor, a gear assembly, and a swivel plate, a base plate, and a bearing.

A plurality of sensors are designed to detect pressure from the cable are placed on the fairlead, which guides the cable along the drum as it unwinds or winds on to or off of the drum. Because the cable passes through the orifice of the fairlead, placing a plurality of sensors on the portion of the fairlead that form the orifice allows for the cable to be in contact with the sensors.

The plurality of sensors may comprise two sensors, such that the sensors are placed on opposing sides of the orifice, in a first plane that is parallel with the drum axis, and wherein the swivel plate swivels in a second plane that is parallel with the drum axis.

The plurality of sensors may comprise two sensors, such that the two sensors are located on opposing sides of the orifice, in a third plane that is perpendicular with the drum axis, and wherein the swivel plate swivels in a fourth plane that is perpendicular with the drum axis. In this embodiment, the sensors might be placed at the upper and lower portions of the portion of the fairlead that forms an orifice, thus allowing the winch to tilt upwards or downwards in response to detected pressure from the sensors.

In another embodiment, the swivel winch comprises four sensors. Two of the four sensors are located on opposing sides of the orifice, in a first plane that is parallel with the drum axis and two of the four sensors are located on opposing sides of the orifice, in a third plane that is perpendicular with the drum axis.

The swivel winch is designed such that the swivel plate, bearing, and base plate permit the swivel winch to rotate about the plane parallel with the drum axis.

The controller of the winch receives data from the sensors as they detect pressure from the cables. The controller, upon receiving the data, will determine whether or not to generate a command for the actuator based on whether or not the data from the sensors indicates that a pressure threshold is passed. If the pressure threshold is passed, the controller generates a command and the actuator actuates the command, causing the swivel winch to swivel. The controller generates a command for a swivel position that minimizes the pressure data received from each of the plurality of sensors, and by determining an actuator position that will achieve the swivel position.

The controller may also generate the command by determining the command that will actuate the actuator to achieve the actuator position.

The actuator may be a motor, or another device that actuates.

The swivel winch allows for a user to override the controllers commands, in the event that a user prefers to determine the angle of the winch to the load.

The sensors and the portion of the fairlead that form the orifice are smooth such that friction is reduced when the cable is sliding through the orifice while winding or unwinding on or off of the drum.

The bearing may be plain bearing, rolling-element bearing, fluid bearing or magnetic bearing, and the sensors may be an absolute pressure sensor, a sealed pressure sensor, a differential pressure sensor.

In another embodiment, the swivel winch is attachable to vehicles, and thus may be used while attached to a vehicle or while unattached to a vehicle.

DETAILED DESCRIPTION

Figure 1A:
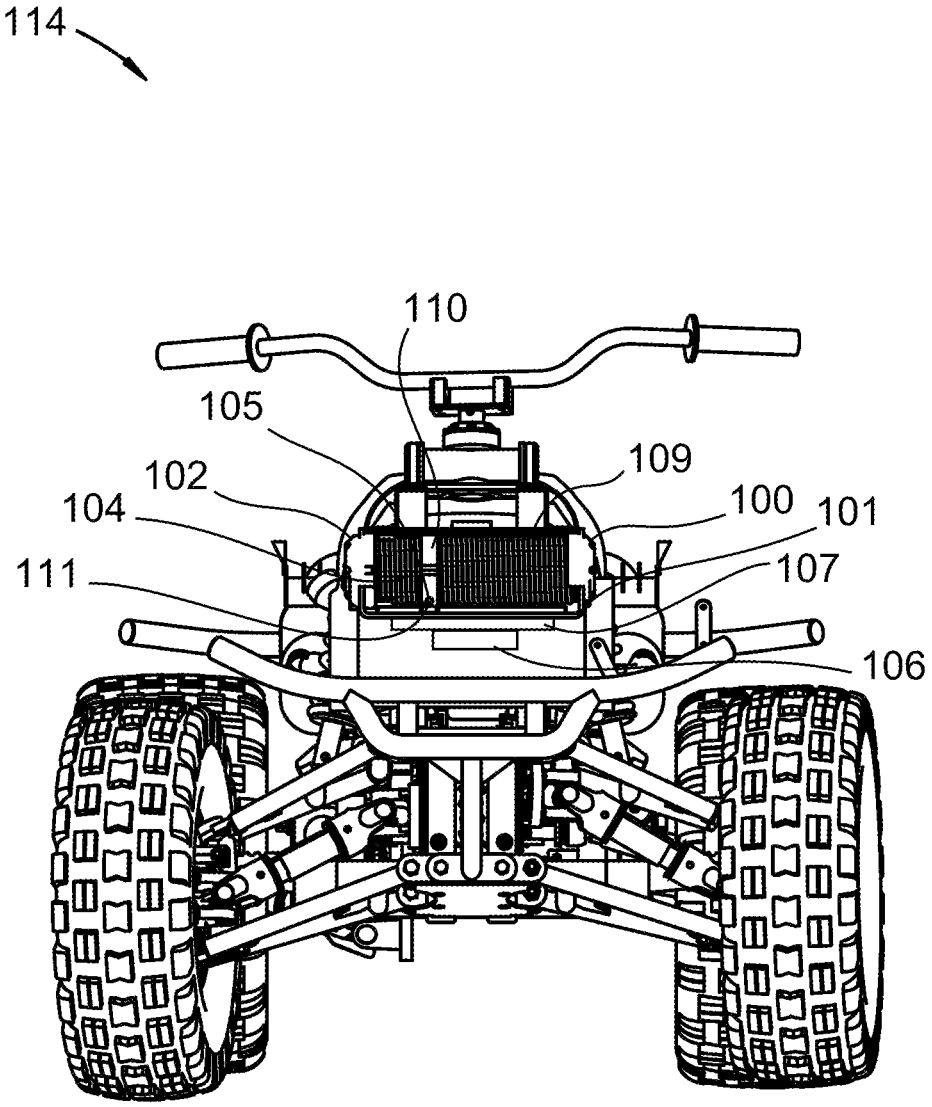
FIG. 1A depicts a swivel winch 100, according to one embodiment

In the following detailed description, numerous specific details are provided for a thorough understanding of the various embodiments disclosed herein. The embodiments disclosed herein can be manufactured without one or more of the specific details, or with other methods, components, materials, etc. In addition, in some cases, well-known structures, or characteristics may be combined in any suitable manner in one or more alternative embodiments.

Winches in their most basic form have been used for many years to help hoist or move objects. Winches can be used in a variety of settings. They are used on boats, on cars, in a building, in a theatre, on a construction site, indoors or outdoors. They are extremely useful because they help users to maneuver often large or heavy equipment or materials in such a way that would be extremely difficult to do manually.

Winches are used to pull in or let out tension on a rope. There exists a wide variety of winches comprised of different materials. One of the challenges associated with winches is that pulling capacity may be diminished when a load is not perpendicular to the drum. Typically, this challenge is addressed by using a fairlead that includes rollers to reduce the friction associated with off-angle loads (loads that result in the winch cable not being perpendicular with the winch drum, for example). However, even with a fairlead that includes rollers, the winch capacity for off-angle loads is reduced, and the pressure and friction of the fairlead may result in increased wear on the winch cable and/or the winch components.

Embodiments and methods disclosed herein may improve winch performance when the load is at a wide angle to the fairlead. The present devices, systems, and methods describe a winch that includes a swivel mechanism (e.g., swivel winch). As described herein, the swivel winch may swivel to orient itself in a way that minimizes or eliminates off-angle loads. In other words, the swivel winch may rotate towards a load that the swivel winch is pulling, such that there is less friction on the cable when being wound onto the drum. This allows for increased efficiency and increases the capacity of the winch to pull heavier items or loads.

Depending on the environment and scenario in which a winch is used, one of the common use cases for winches, for example, is for a winch to be placed on a vehicle (e.g., all-terrain vehicle (ATV), truck, utility vehicle, and the like). Typically, the winch is placed at the front (or back) of the vehicle. This placement may be ideal for some use cases. A vehicle, however, may or may not be able to be situated directly in the front or the back of the load to be pulled. Furthermore, the vehicle may or may not be able to be situated on the same level as the load to be pulled. When using the winch, it is most efficient when directly facing the load it is pulling because friction is reduced and efficiency is increased. Thus, it is beneficial for a winch to have the ability to tilt, rotate, and/or twist in order to face the load being pulled so that it is directly facing the load to be pulled.

It is appreciated, that pulling off-angle reduces the efficiency and ability of all winches. Pulling off-angle, however, may be particularly problematic for winches that include a winch-line-guide that directs the line to wind along the length of the rotatable drum to avoid bunching or catching the line on the rotatable drum. In one embodiment, a motor powers the drum to rotate about an axis within a frame. A fairlead of the winch-line-guide may be connected to and may simultaneously move along the length of one or more elongated rods, which extend longitudinally within the frame in substantially parallel relation to the drum axis. As the fairlead moves along the rods, the line passes through the fairlead such that the fairlead directs the line to wind uniformly around the drum. When pulling off-angle, however, the fairlead may, at times, be unable to move along the drum length due to the force of the load working against the movement direction of the fairlead. A winch-mount that changes the direction of the drum and fairlead may resolve this problem and allow the fairlead to smoothly move along the length of the drum.

In one embodiment the swivel winch may include sensors in proximity to the orifice on the fairlead which sense/detect pressure. When pressure exceeds a predetermined threshold, the swivel winch is instructed to swivel, tilt, and/or rotate in the direction that will most relieve the sensed pressure. Thus, sensors may be used to allow the fairlead to operate without decreasing efficiency.

In some embodiments, the mounting-plate (to which the winch is mounted, for example) may oscillate, rotate, balance, pivot, turn, tilt, teeter, vacillate, hover, hang, sway, and/or dither. The mounting-plate may be connected to the winch frame in some embodiments. The winch may include one or more spacers, insertions, and/or attachments between the rotatable drum and the mounting-plate. Some embodiments of the mounting-plate may include one or more protrusions, attachments, flanges, extensions, shelves, depressions, grooves and/or other surface discontinuities that interact with springs. In one embodiment, the mounting-plate may include one or more folds, bends, creases, and/or curvatures such that the degree to which the rotatable drum tilts is as much as 180° from rest. The mounting-plate may also rotate as much as 360° around the center pivot, according to one embodiment.

The following detailed description refers to the accompanying drawings. The same reference numbers may be used in different drawings to identify the same or similar elements. In the following description, for purposes of explanation and not limitation, specific details are set forth such as particular structures, architectures, interfaces, techniques, etc. in order to provide a thorough understanding of the various aspects of various embodiments. However, it will be apparent to those skilled in the art having the benefit of the present disclosure that the various aspects of the various embodiments may be practiced in other examples that depart from these specific details. In certain instances, descriptions of well-known devices, circuits, and methods are omitted so as not to obscure the description of the various embodiments with unnecessary detail.

FIG. 1A depicts a swivel winch 100, according to one embodiment. The swivel winch 100 includes a winch frame 101, two end brackets 102, a swivel plate 107, a base plate 106, and an actuator 109. A winch drum 103 is disposed within the frame 101 and between and the end brackets 102. Attached to the winch drum 103 is a cable 104 which can wind and unwind on and off the drum 103. The cable 104 may be configured such that it may unwind off the drum 103 from left to right, or from right to left, via the fairlead 110 through a small hole on the guide 111, which prevents the cable 104 from tangling when winding on or off the drum 103. The sensors 105 placed across from one another on the orifice 111 of the fairlead 110, sense the amount of pressure from the cable 104 when it is being pulled on either side. A predetermined threshold, if exceeded, will cause the controller 108 to generate a command for the actuator 109, in this embodiment a motor, which turns the swivel winch 100.

The swivel winch 100 in this embodiment is on an ATV 114. The swivel winch 100 can be mounted upon many different vehicles because it is detachable. A swivel winch 100 can fit an automobile, a tractor, a truck, a boat, a tank, an armored fighting vehicle, a military engineering vehicle, an ambulance, a train, a draisine, or a reconnaissance vehicle. This is extremely useful because a swivel winch 100 is designed to pull a large variety of things in a large variety of situations, and because the swivel winch 100 can attach to different vehicles, it becomes useful in many more situations. For example, a swivel winch 100 could attach to a truck and be used to pull a tree trunk out of the ground. It could be attached to an ATV 114 to pull an object stuck in mud out of the mud. A swivel winch 100 might also be attached to an automobile and then used to pull another automobile. A swivel winch 100 might also be attached to an automobile, ATV 114, truck, or tractor to fell a tree, or to pull a boat out of water. The swivel winch 100 is removably attached to a vehicle so that it can be attached to any one vehicle, used, then removed, and attached to another vehicle for a different purpose. Additionally, the swivel winch 100 may be attached to a non-vehicle.

Figure 1B:
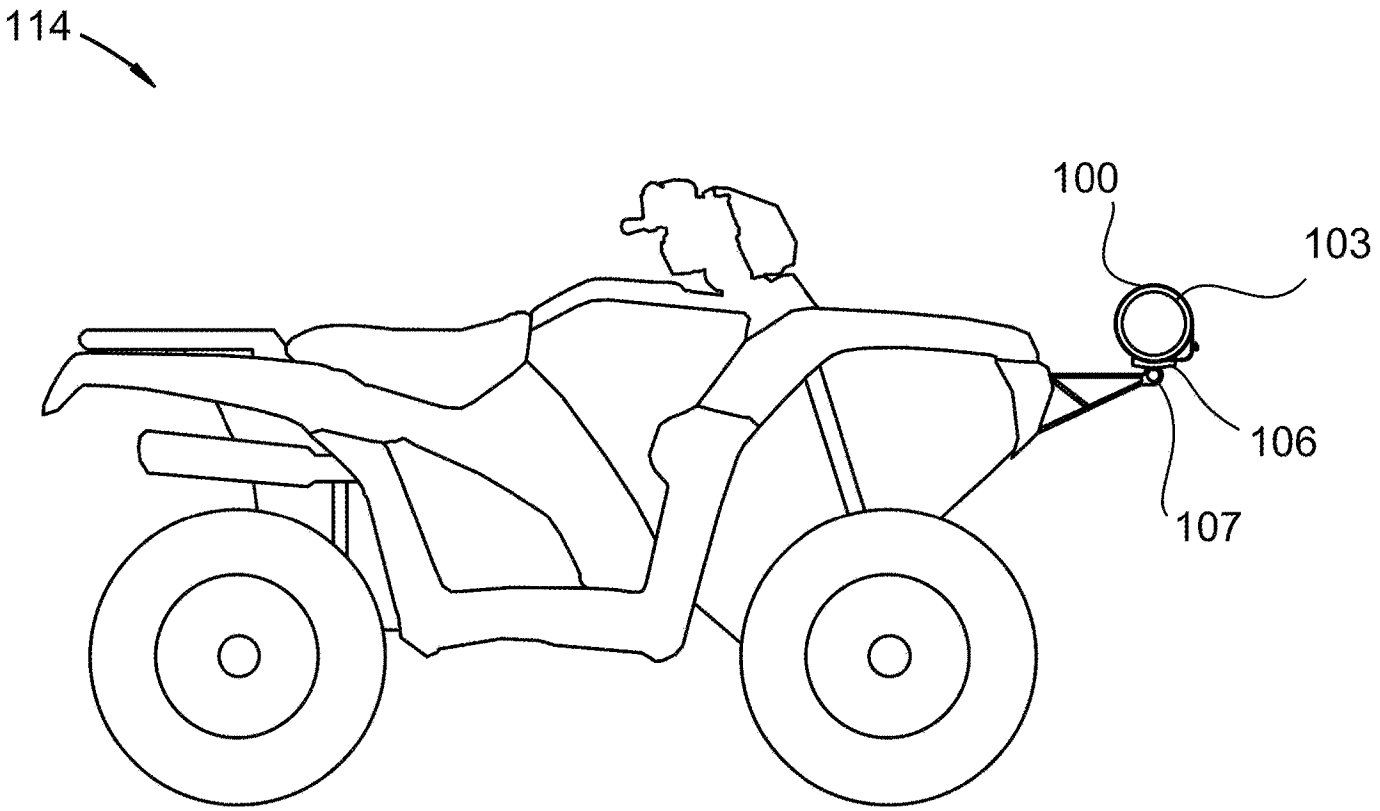
FIG. 1B illustrates a side view of a swivel winch 100 attached to an ATV 114.

FIG. 1B illustrates a side view of a swivel winch 100 attached to an ATV 114. The winch frame 101 is attached to a swivel plate 106, which is attached to a base plate 107. A bearing 108 permits the swivel plate 106 to rotate about the axis of the base plate, which allows the winch to face different directions.

Figure 2:
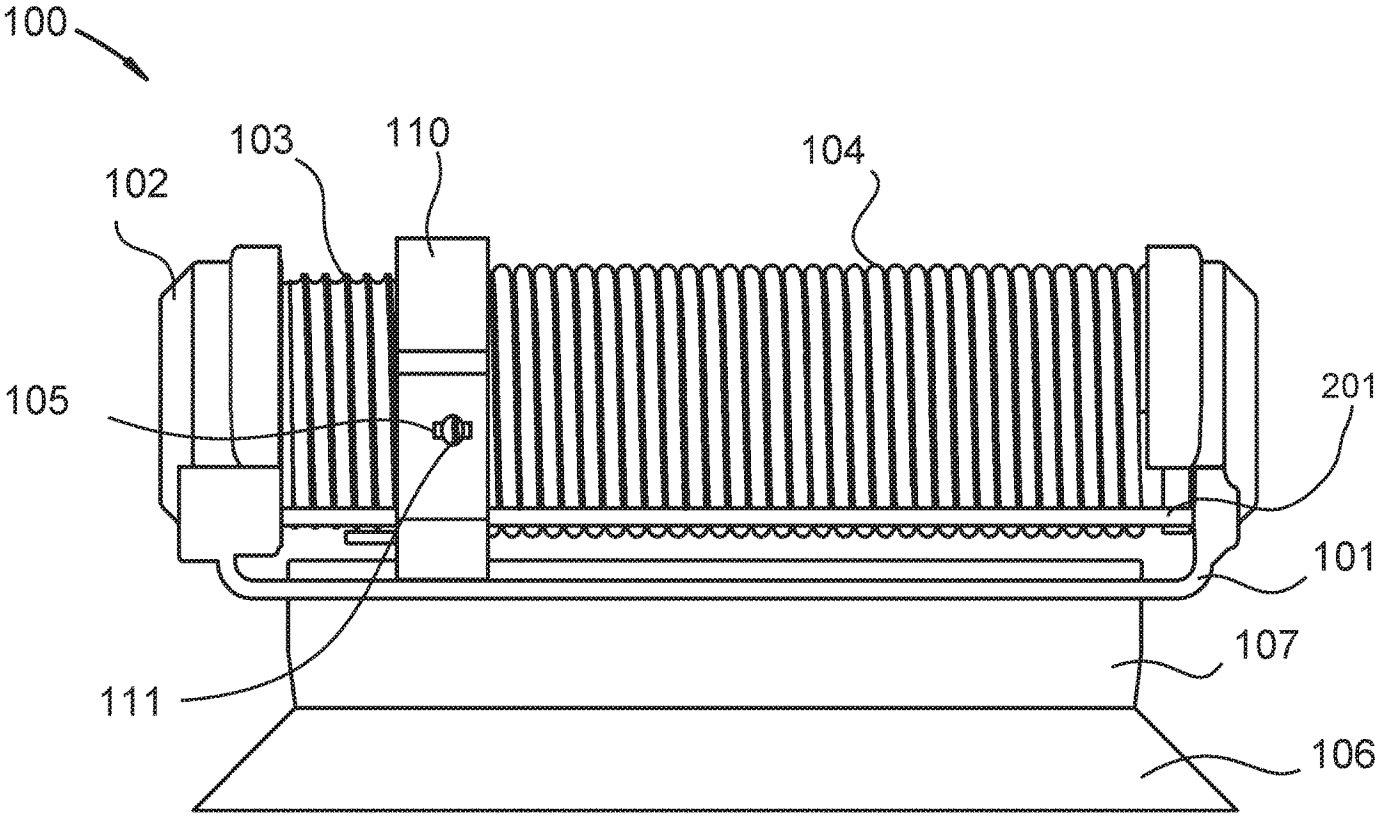
FIG. 2 depicts a swivel winch 100 with a winch frame 101 attached to a swivel plate 107 attached to a base plate 106.

FIG. 2 depicts a swivel winch 100 with a winch frame 101 attached to a swivel plate 107 attached to a base plate 106. The fairlead 110 is depicted by an end bracket 102. Two sensors, 105, are placed opposite one another in proximity to the orifice 111 of the fairlead 110, which moves along guide rod 201. This embodiment is advantageous because when a load is positioned at a wide angle relative to the swivel winch 100, the cable 104 will pull against one of the sensors 105. As the controller retrieves the sensor data 105, it will generate a command for the actuator 109 to turn the swivel winch 100.

Figure 3:
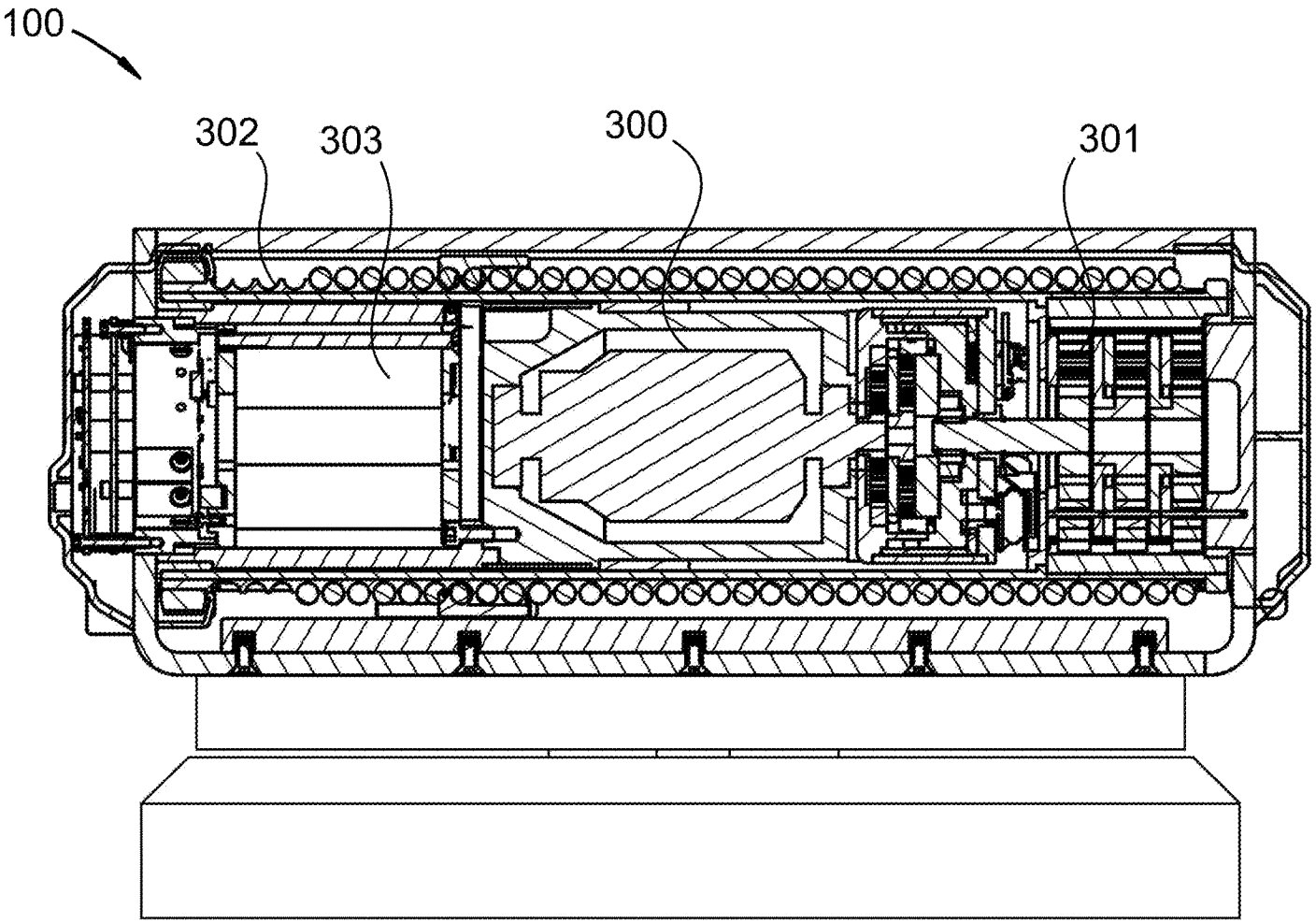
FIG. 3 is a cross-sectional view of the swivel winch 100 of FIG. 1A, which shows the inner workings of the winch 100.

FIG. 3 is a cross-sectional view of the swivel winch 100 of FIG. 1A, which shows the inner workings of the winch 100. A winch motor 300 is disposed inside the drum 103, and is attached to a gear assembly 301 and the winch drum 103. When the winch motor 300 and the gear assembly 301 operate together the winch drum 103 rotates, to either wind or unwind the cable 104. The drum 103 in many embodiments is shaped as a right circular cylinder; however, the drum 103 can be of any variety shapes including an elliptic cylinder, a parabolic cylinder, a hyperbolic cylinder, an oblique cylinder, a cuboid, a rounded cuboid, a triangular prism, and/or any of a variety of other shapes. In some embodiments, the drum 103 includes a plurality of helical grooves 302 to assist in uniformly winding the cable 104 onto the drum 103. A winch controller 108 comprises software in communication with the motor, such that the controller 108 receives pressure information from the sensors 105 and generates commands for the actuator 109 to move the winch accordingly. As illustrated, the swivel winch 100 includes a battery 303, which powers the actuator 109, which may be a motor.

Figure 4:
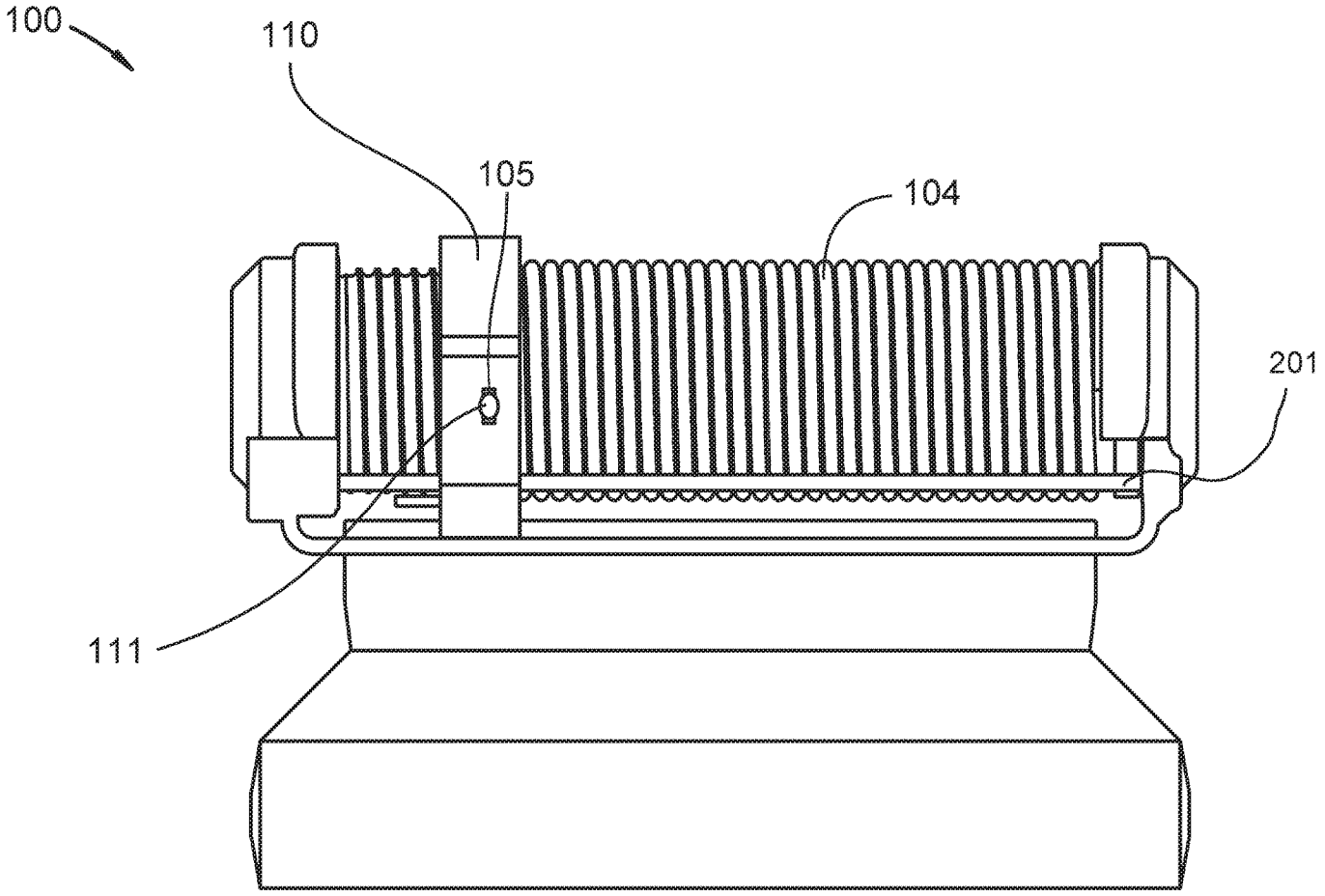
FIG. 4 depicts a swivel winch 100 with two sensors 105 placed at the top and bottom of the orifice 111 or the fairlead 110.

FIG. 4 depicts a swivel winch 100 with two sensors 105 placed at the top and bottom of the orifice 111 or the fairlead 110, which moves along guide rod 201. With two sensors 105 positioned as such, the sensors 105 will be able to detect when the cable 104 is pulling against the top of the orifice 111 of the fairlead 110, or when the cable 104 is pulling against the bottom of the orifice 111 of the fairlead 110. This may occur when a load that a user desires to pull is positioned at a higher level or lower level than the winch is able to be positioned at. For example, if a user wishes to pull a boat out of water via a ramp, often times the ramp is at a slant and a swivel winch 100 would be higher than the boat. This would cause the cable 104 to pull down against the fairlead 110. By positioning a sensor 105 at the bottom and top of the orifice 111 of the fairlead 110, the controller 108 will sense when the cable 104 is applying pressure to the sensor and generate a command for the actuator 109 to rotate the swivel winch 100 downwards until the pressure is relieved.

Figure 5:
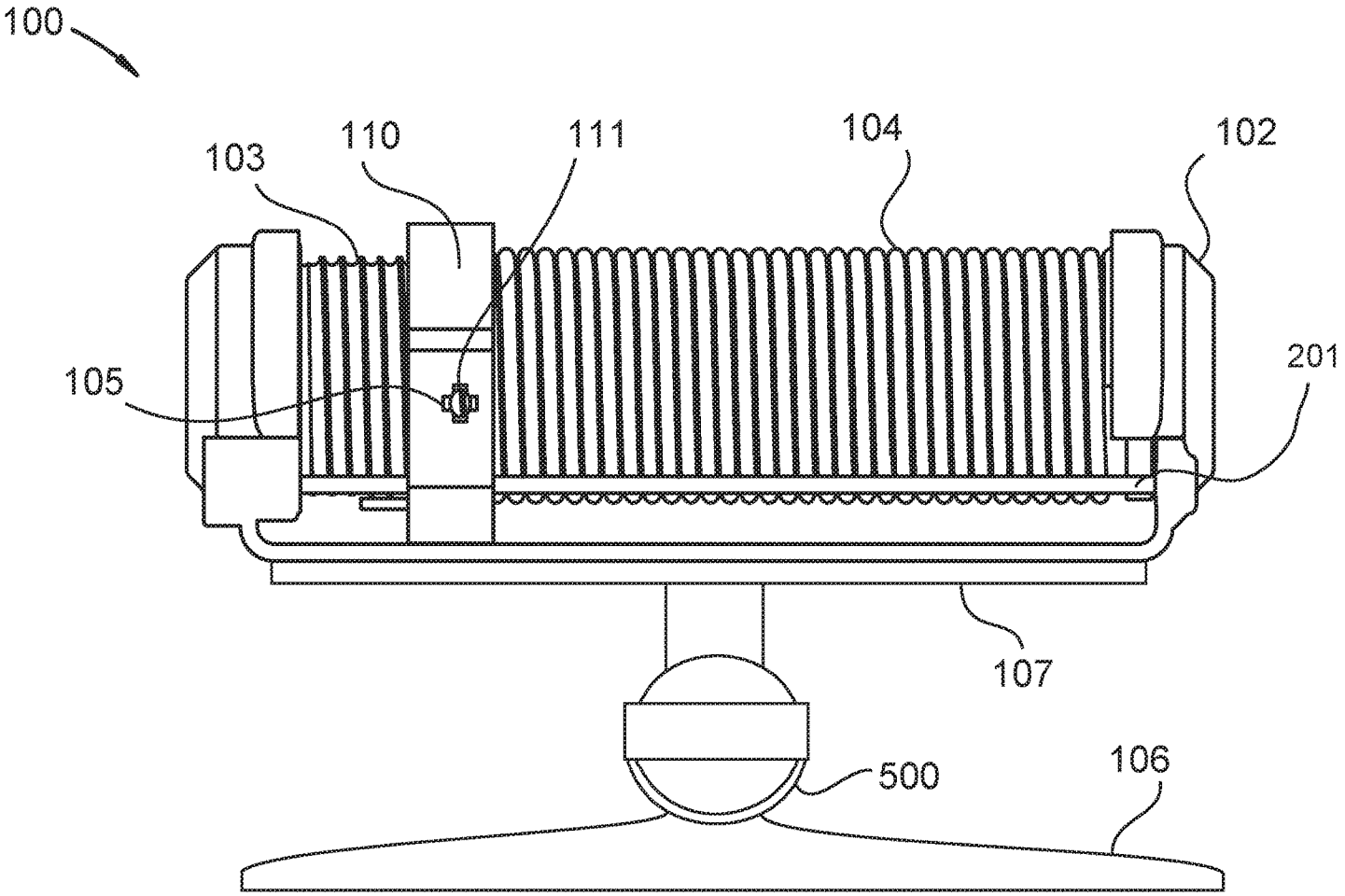
FIG. 5 illustrates a swivel winch 100 comprising four sensors 105.

FIG. 5 illustrates a swivel winch 100 comprising four sensors 105. This embodiment is advantageous because it relieves pressure whether it is applied to the top, bottom, or either side of the orifice 111 of the fairlead 110, which moves along guide rod 201. A swivel plate 106 is attached to a ball joint 500 which is coupled to the base plate 107. The ball joint 500 allows the actuator to move the swivel plate 106 up, down, or from side to side.

Figure 6:
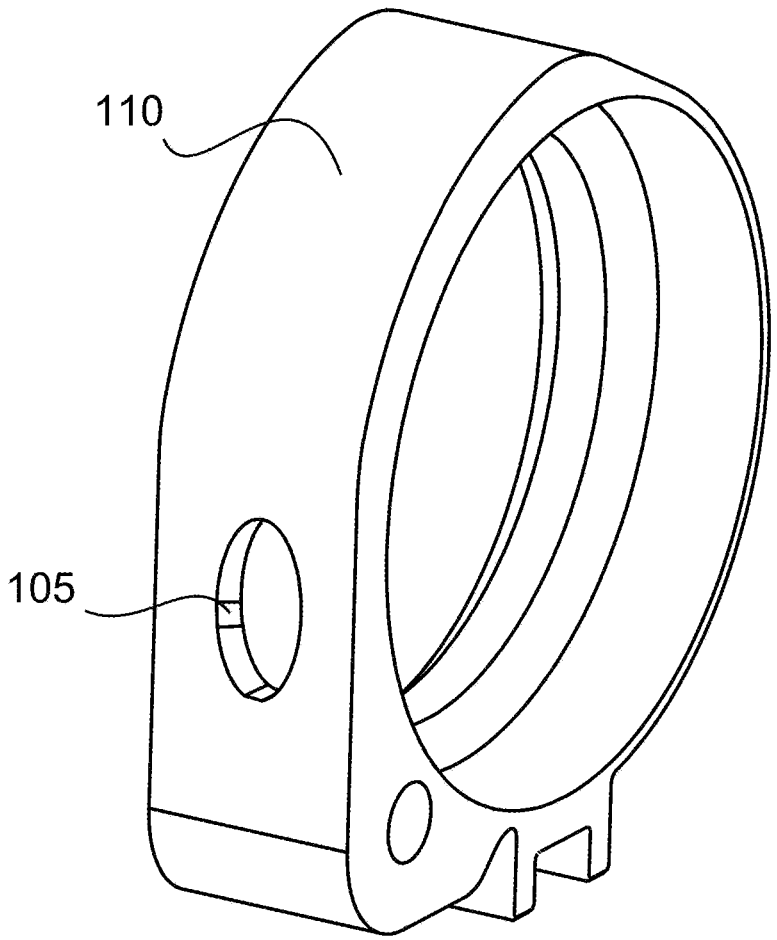
FIG. 6 depicts a fairlead 110 zoomed in for greater detail.

FIG. 6 depicts a fairlead 110 zoomed in for greater detail. The sensors 105 are depicted on the inside of the fairlead 110. The sensors 105 may also be placed on the outside of the fairlead.

Figure 7A:
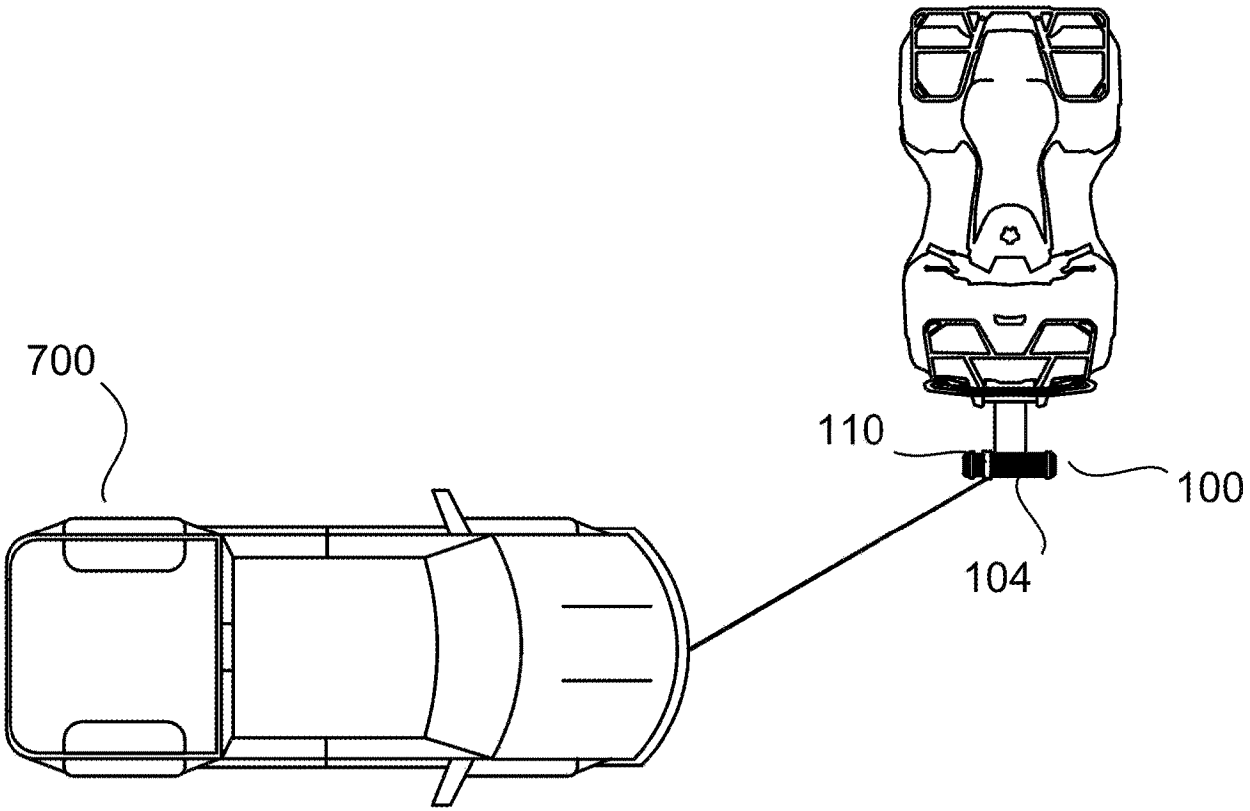
FIG. 7A depicts a vehicle 700 as the load of a winch 100.

FIG. 7A depicts a vehicle 700 as the load of a winch 100. The vehicle 700 is positioned at a wide angle from the swivel winch 100. Thus there is friction created from the cable 104 rubbing against the fairlead 110, which is inefficient.

Figure 7B:
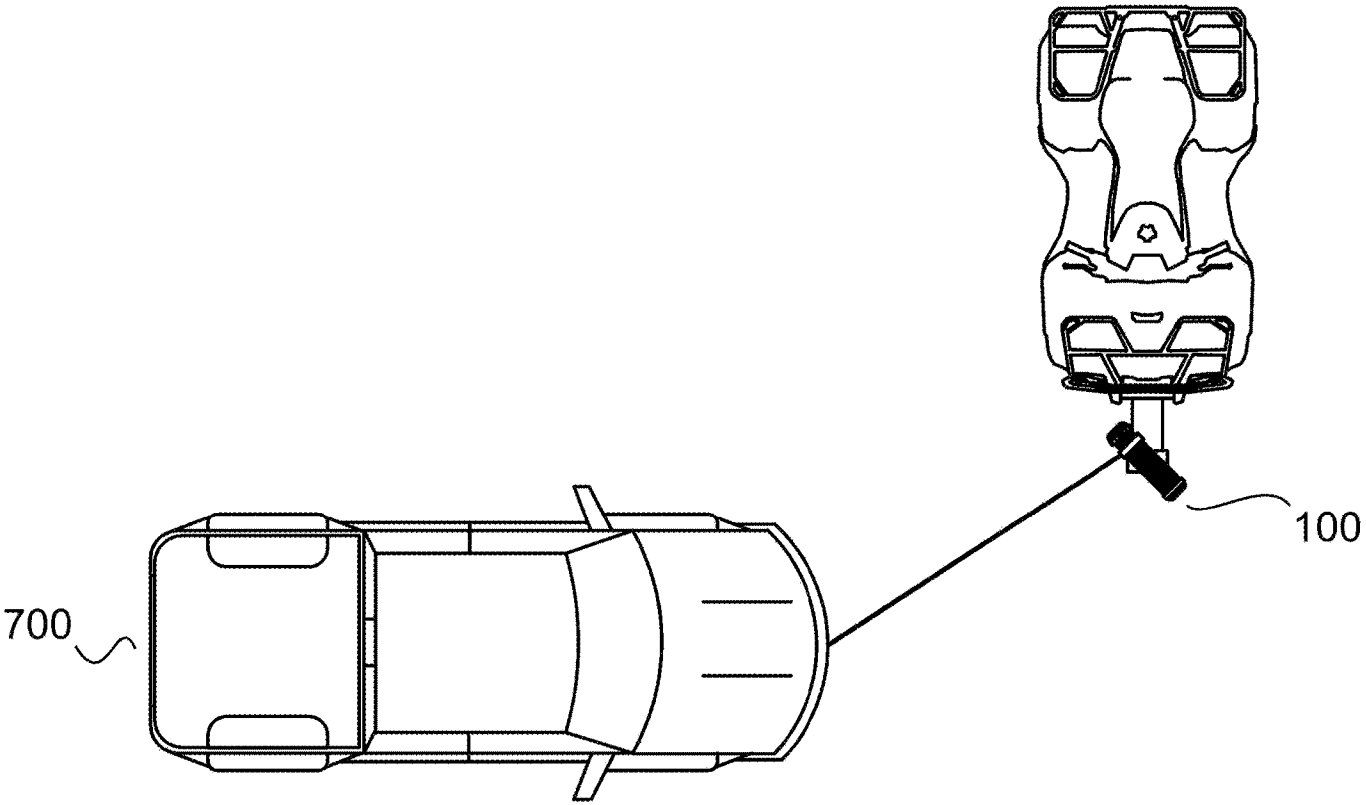
FIG. 7B depicts the vehicle 700 of FIG. 7A, wherein in the swivel winch 100 has swiveled to directly face the vehicle 700.

FIG. 7B depicts the vehicle 700 of FIG. 7A, wherein in the swivel winch 100 has swiveled to directly face the vehicle 700, using the systems and methods described herein.

Figure 8A:
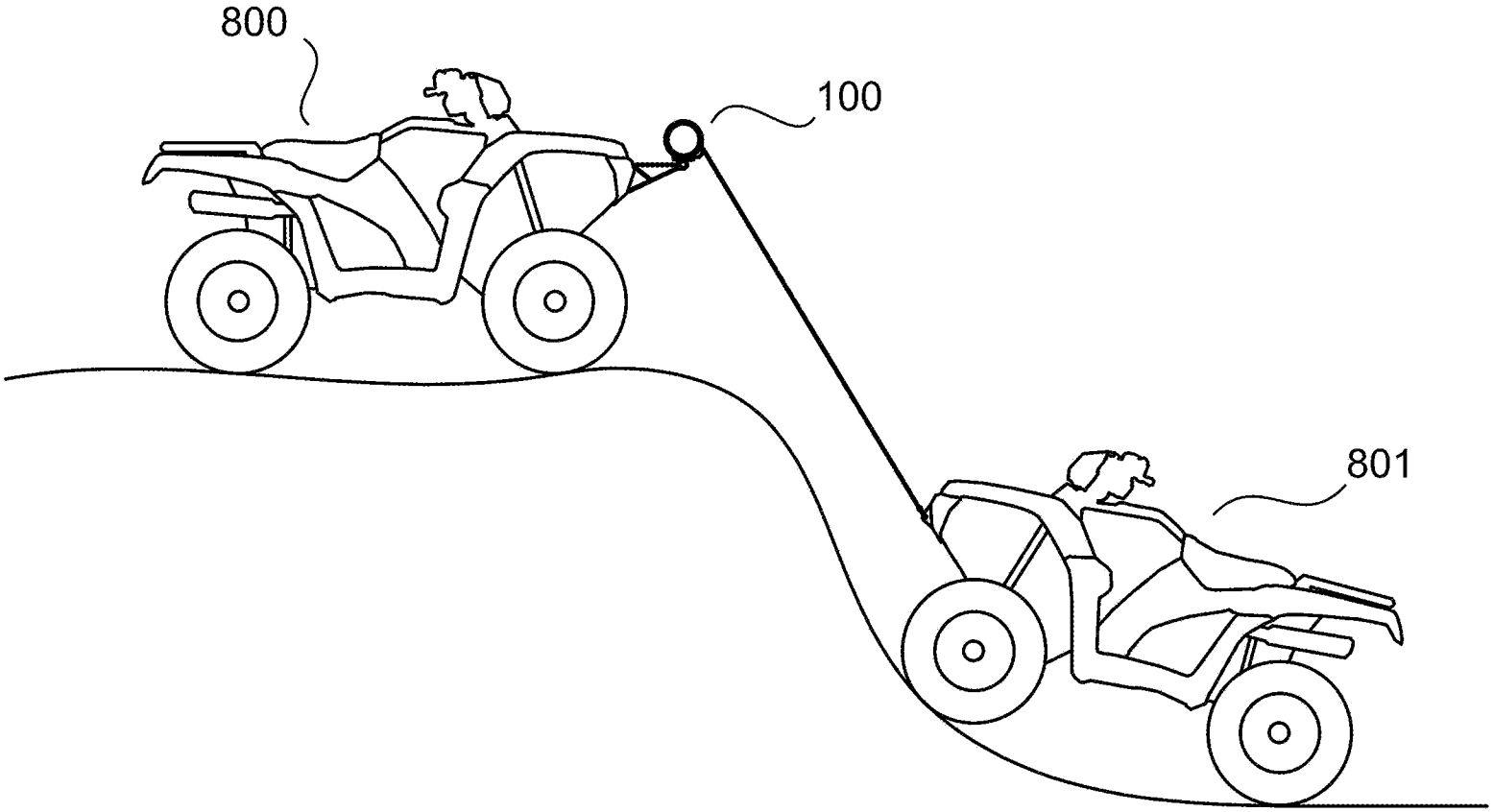
FIG. 8A depicts a vehicle 800 with a swivel winch 100 attached to the front.

FIG. 8A depicts a vehicle 800 with a swivel winch 100 attached to the front. The vehicle 800 and the swivel winch 100 are placed above a load 801. As such, the cable 104 is pulling downwards against the fairlead 110, creating friction and reducing efficiency.

Figure 8B:
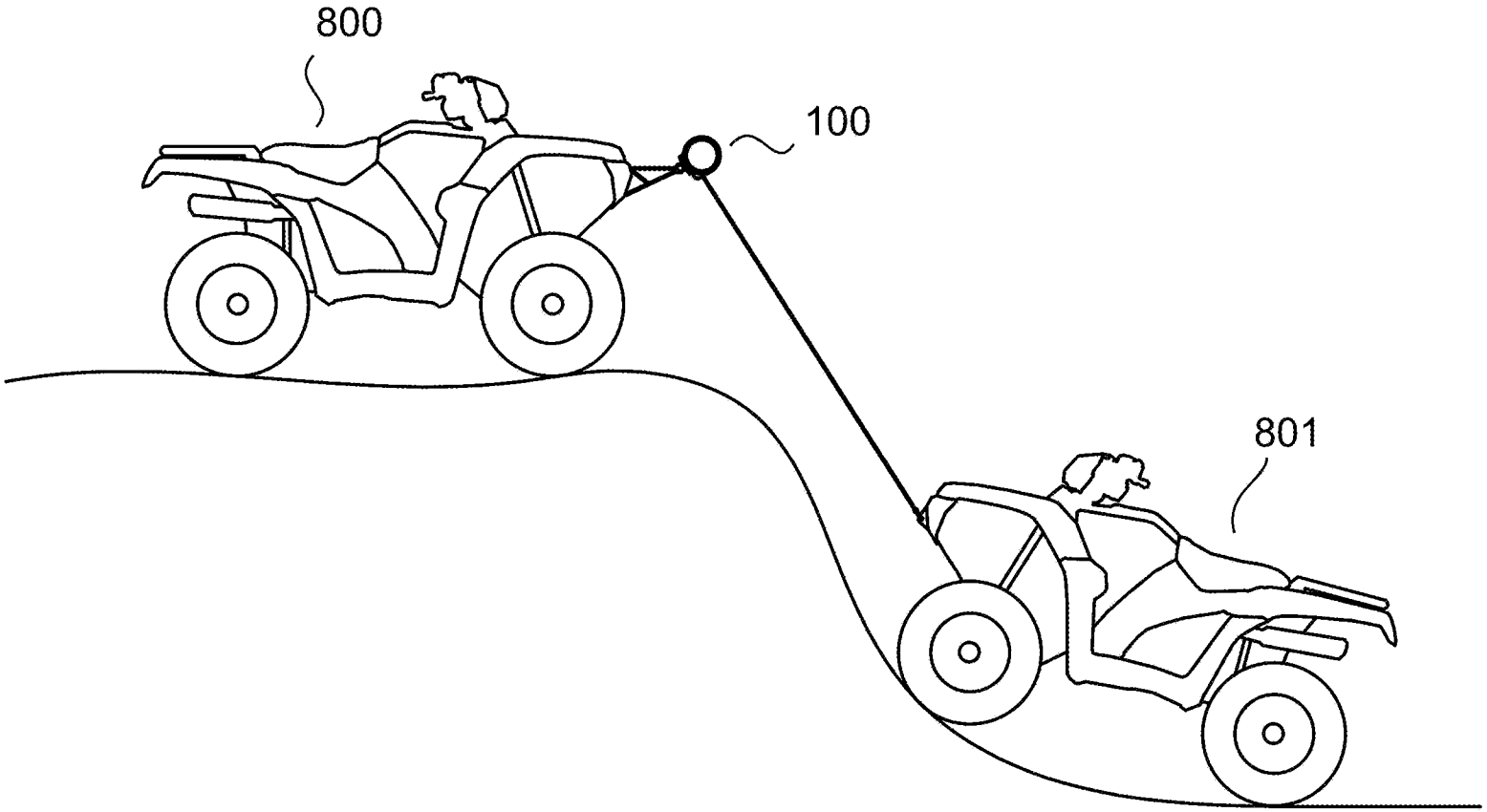
FIG. 8B depicts the vehicle 800 of image 8A and the winch 100 pulling the load 801.

FIG. 8B depicts the vehicle 800 of image 8A and the winch 100 pulling the load 801. The sensors 105 have sensed increased pressure and the controller 108 has received this information and caused the swivel winch 100 to rotate downwards to relieve pressure and increase efficiency.

Figure 9:
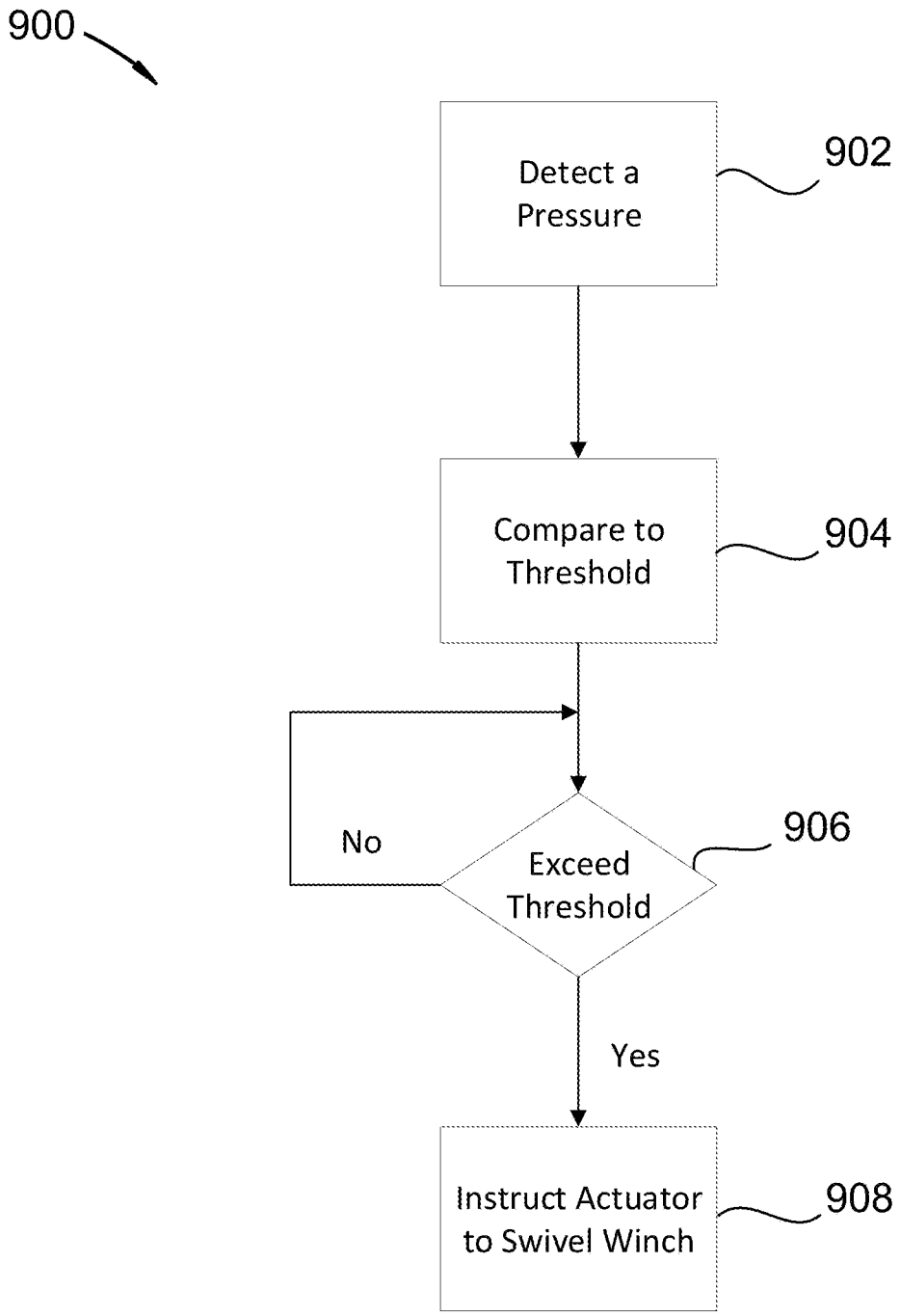
FIG. 9 depicts a flow diagram of a method 900 for performing swiveling.

FIG. 9 depicts a flow diagram of a method 900 for performing swiveling. The method 900 is performed by a winch, such as a swivel winch. In particular, the method 900 may be performed by a processor within the winch. Although the operations of method 900 are illustrated as being performed in a particular order, it is understood that the operations of method 900 maybe reordered without departing from the scope of the method.

At 902 the sensors 105 detect a pressure.

At 904, the pressure is compared to a threshold.

At 906, if the pressure does not exceed the threshold, it is compared to the threshold again. If the pressure does exceed the threshold, at 908, the actuator is instructed to swivel the winch.

The operations method 900 may be performed by a winch, programmable application specific integrated circuit (ASIC), field programmable gate array (FPGA), or the like.

Figure 10:
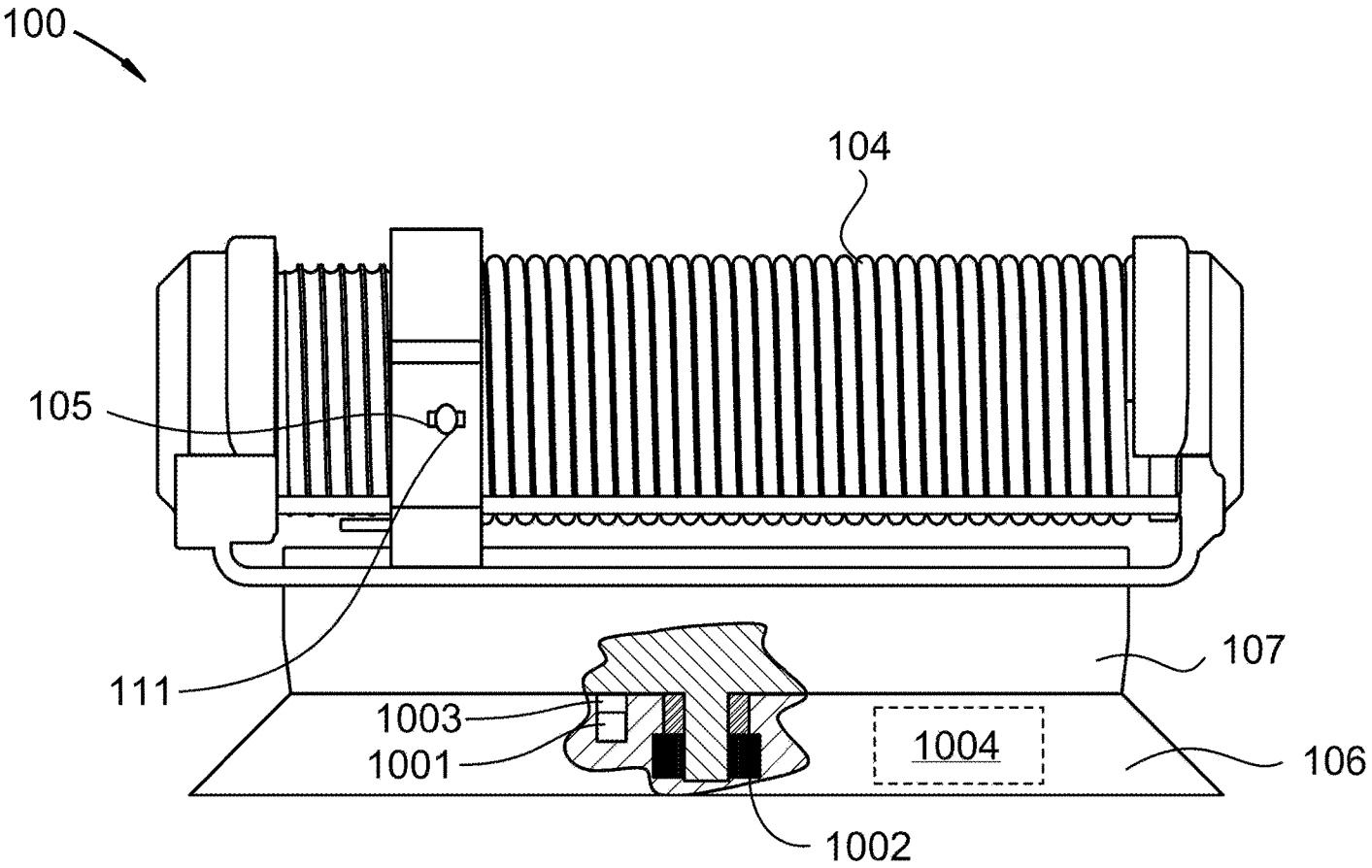
FIG. 10 depicts an embodiment similar to FIG. 2 with a broken out view showing an actuator 1001, a spring 1002, and a mechanical lock 1003.

FIG. 10 depicts an embodiment similar to FIG. 2 with a broken out view showing an actuator 1001, a spring 1002, and a mechanical lock 1003. The spring 1002 may be connected to the base plate 106 and the swivel plate 107. The spring 1002 may bias the swivel plate 107 to a forward orientation with respect to the base plate 106. The mechanical lock 1003 may be connected to the base plate 106. The mechanical lock 1003 may selectively engage to prevent motion of the swivel plate 107 relative to the base plate 106. The actuator 1001 may selectively engage the mechanical lock. The swivel winch 100 may include a controller 1004 that may control the actuator 1001. The controller 1004 may control the actuator 1001 based on pressure data from the sensors 105.

For example, a portion of the cable 104 may pass through the orifice 111 and may apply a pressure to one of the sensors 105. The one of the sensors 105 may send pressure data to the controller 1004. The controller 1004 may subsequently send a signal to the actuator 1001 to disengage the mechanical lock 1003. The mechanical lock 1003 may disengage. Subsequently, the cable 104 may release the aforementioned pressure from the one of the sensors 105. The one of the sensors 105 may send pressure data to the controller 1004. The controller 1004 may subsequently send a signal to the actuator 1001 to engage the mechanical lock 1003. The mechanical lock 1003 may engage.

The mechanical lock 1003 may prevent the swivel plate 107 from moving with respect to the base plate 106, by any of a variety of means, including by applying a force which may generate a frictional force or moving a pin which interferes with motion of base the base plate 106 relative to the swivel plate 107.

Figure 11:
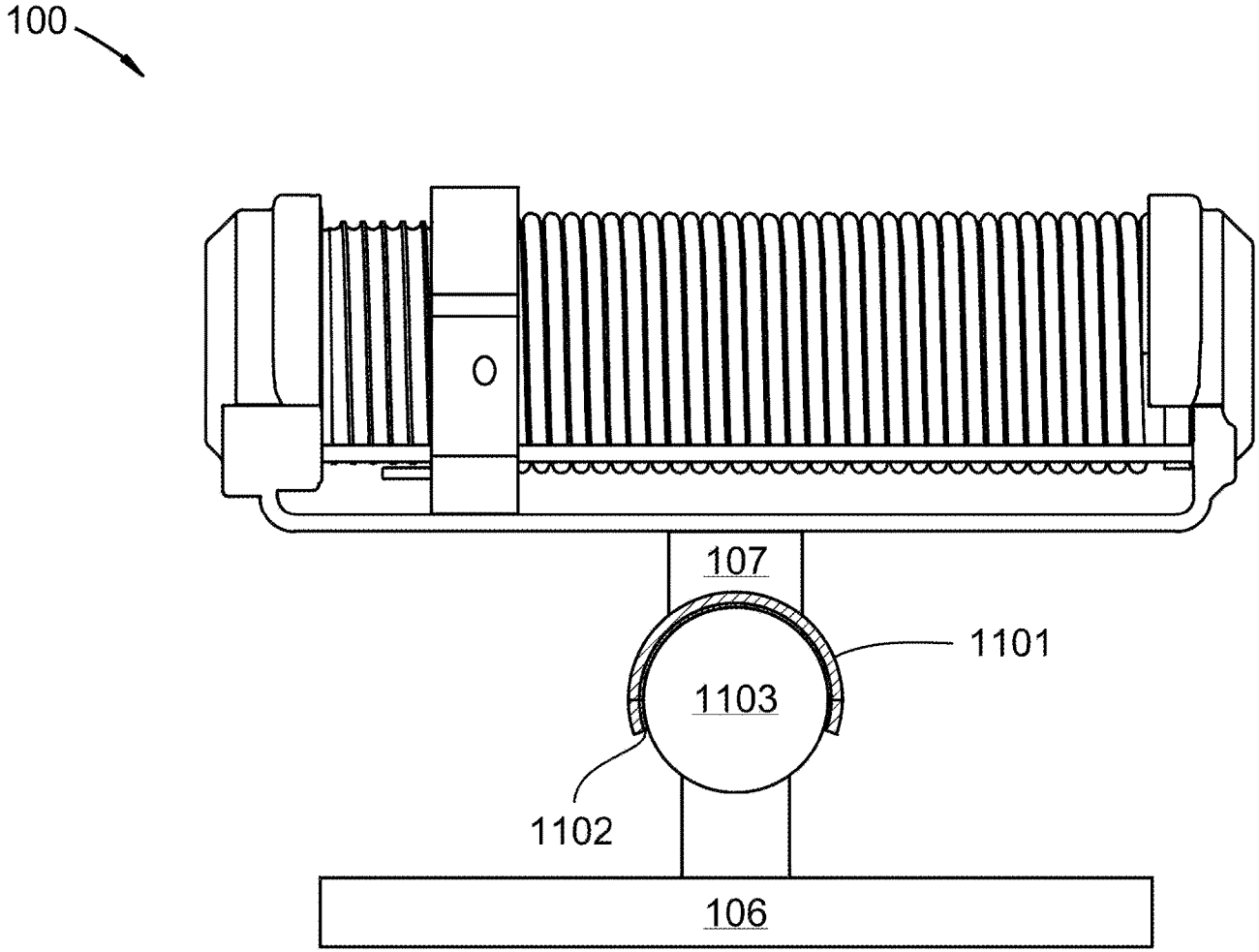
FIG. 11 depicts a swivel winch 100 attached to a ball joint 500 such that it may move in response to applied pressure.

FIG. 11 depicts a swivel winch 100 attached to a swivel plate 107, wherein the swivel plate 107 is attached to a receiver hitch 1103, comprised of a socket 1101 and a ball joint 500. The receiver hitch 1103 is attached to the base plate 106. In this embodiment, the swivel winch 100 may rotate or move in response to a load pulling the cable 104 in a direction which causes the cable 104 to apply pressure to a part of the fairlead 110. The receiver hitch 1103 and the socket 1101 are configured such that there is friction 1102 between them. The friction 1102 holds the swivel winch 100 in place when the swivel winch 100 is not bearing a load, and when the vehicle is bouncing around, on a bumpy road for example, which could result in a swivel winch 100 also bouncing around. As such, the resistance and direction of the load provide the force to move the socket 1101 around the ball joint 500 to swivel the winch with respect to the receiver where the swivel mounts.

The invention claimed is:

1. A winch assembly, comprising:

a winch frame having a first end bracket and a second end bracket;

a winch drum disposed within the frame between the first end bracket and the second end bracket, wherein the winch drum is rotatable about a drum axis defined by the first end bracket and the second end bracket;

a winch cable windably connected to the winch drum;

a guide rod mounted on the winch frame and disposed substantially parallel to the drum axis;

a fairlead slidably attached to the guide rod, the fairlead comprising an orifice through which the winch cable passes, the fairlead for positioning the winch cable onto the winch drum;

a plurality of sensors circumferentially mounted to the orifice, wherein each of the plurality of sensors detect pressure from the winch cable, each of the plurality of sensors providing pressure data;

a swivel mount coupled to the winch frame, the swivel mount comprising a base plate, a bearing, and a swivel plate, wherein the winch frame is coupled to the swivel plate;

an actuator that swivels the swivel plate with respect to the base plate; and a controller that controls the actuator, wherein the controller controls the actuator based on the pressure data.

2. The winch assembly of claim 1, wherein the plurality of sensors are mounted within the orifice.

3. The winch assembly of claim 1, wherein the plurality of sensors comprises two sensors.

4. The winch assembly of claim 3, wherein the two sensors are located on opposing sides of the orifice, in a first plane that is parallel with the drum axis, and wherein the swivel plate swivels in a second plane that is parallel with the drum axis.

5. The winch assembly of claim 3, wherein the two sensors are located on opposing sides of the orifice, in a third plane that is perpendicular with the drum axis, and wherein the swivel plate swivels in a fourth plane that is perpendicular with the drum axis.

6. The winch assembly of claim 1, wherein the plurality of sensors comprises four sensors.

7. The winch assembly of claim 6, wherein two of the four sensors are located on opposing sides of the orifice, in a first plane that is parallel with the drum axis and two of the four sensors are located on opposing sides of the orifice, in a third plane that is perpendicular with the drum axis.

8. The winch assembly of claim 7, wherein the swivel plate swivels in both a second plane that is parallel with the drum axis and a fourth plane that is perpendicular with the drum axis.

9. The winch assembly of claim 1, wherein the controller receives pressure data from each of the plurality of sensors.

10. The winch assembly of claim 9, wherein the controller controls the actuator by generating a command for the actuator, wherein the command is based on the pressure data, and wherein the actuator swivels the swivel plate based on the command.

11. The winch assembly of claim 10, wherein the controller generates the command by determining a swivel position that minimizes the pressure data received from each of the plurality of sensors.

12. The winch assembly of claim 11, wherein the controller generates the command by determining an actuator position that will achieve the swivel position.

13. The winch assembly of claim 12, wherein the controller generates the command by determining the command that will actuate the actuator to achieve the actuator position.

14. The winch assembly of claim 10, wherein the controller compares the pressure data from each of the plurality of sensors with a predetermined pressure threshold, and generates the command when the pressure data from at least one of the plurality of sensors exceeds the predetermined pressure threshold.

15. The winch assembly of claim 1, wherein the actuator is a motor.

16. The winch assembly of claim 1, wherein the controller is controlled by a user.

17. The winch assembly of claim 1, wherein the swivel mount is attachable to a vehicle.

18. The winch assembly of claim 1, wherein the bearing is a plain bearing, rolling-element bearing, fluid bearing or magnetic bearing.

19. The winch assembly of claim 1, wherein the sensor is one or more of the following: an absolute pressure sensor, a sealed pressure sensor, a differential pressure sensor.

20. A winch assembly, comprising:

a winch frame having a first end bracket and a second end bracket;

a winch drum disposed within the frame between the first end bracket and the second end bracket, wherein the winch drum is rotatable about a drum axis defined by the first end bracket and the second end bracket;

a winch cable windably connected to the winch drum;

a guide rod mounted on the winch frame and disposed substantially parallel to the drum axis;

a fairlead slidably attached to the guide rod, the fairlead comprising an orifice through which the winch cable passes, the fairlead for positioning the winch cable onto the winch drum;

a plurality of sensors circumferentially mounted to the orifice, wherein each of the plurality of sensors detect pressure from the winch cable, each of the plurality of sensors providing pressure data;

a swivel mount coupled to the winch frame, the swivel mount comprising a base plate, a bearing, and a swivel plate, wherein the winch frame is coupled to the swivel plate;

and a receiver hitch comprised of a ball joint and a socket, wherein the receiver hitch is coupled to the base plate.

* * * * *